US009492932B2

(12) United States Patent
Ho

(10) Patent No.: US 9,492,932 B2
(45) Date of Patent: Nov. 15, 2016

(54) SCISSORS WITH BENDABLE AND SHAPE-RETAINING BLADES

(71) Applicant: Lydia M. Ho, Troy, NY (US)

(72) Inventor: Lydia M. Ho, Troy, NY (US)

( * ) Notice: Subject to any disclaimer, the term of this patent is extended or adjusted under 35 U.S.C. 154(b) by 32 days.

(21) Appl. No.: 14/857,840

(22) Filed: Sep. 18, 2015

(65) Prior Publication Data

US 2016/0235179 A1 Aug. 18, 2016

Related U.S. Application Data

(63) Continuation-in-part of application No. 14/624,589, filed on Feb. 18, 2015, now Pat. No. 9,168,661.

(51) Int. Cl.

| | |
|---|---|
| ***B26B 13/10*** | (2006.01) |
| ***B26B 13/04*** | (2006.01) |
| ***A45D 24/36*** | (2006.01) |
| ***B26B 13/06*** | (2006.01) |

(52) U.S. Cl.

CPC ..... *B26B 13/10* (2013.01); *A45D 24/36* (2013.01); *B26B 13/04* (2013.01); *B26B 13/06* (2013.01)

(58) Field of Classification Search

CPC ..... A61B 17/3201; A61B 2018/146; B26B 13/005–13/285

USPC ..... 30/349

See application file for complete search history.

(56) References Cited

U.S. PATENT DOCUMENTS

| | | | | |
|---|---|---|---|---|
| 2,117,224 | A * | 5/1938 | Soss | B26B 13/06 294/118 |
| 2,284,664 | A * | 6/1942 | Kissling | B26B 13/06 30/230 |
| 2,584,603 | A | 2/1952 | McMillan et al. | |
| 2,590,024 | A * | 3/1952 | Lieberman | B26B 13/10 30/230 |
| 2,666,258 | A | 1/1954 | Vogel | |
| 2,677,179 | A | 5/1954 | Servilla | |
| 2,758,371 | A | 8/1956 | Marchesani | |
| 4,048,721 | A * | 9/1977 | Gunson | B26B 13/02 30/254 |
| 5,979,061 | A * | 11/1999 | Demlakian-Apkarian | B26B 13/12 30/232 |
| 6,592,603 | B2 * | 7/2003 | Lasner | A61B 17/2841 30/261 |
| 2005/0149087 | A1 * | 7/2005 | Ahlberg | A61B 17/32001 606/174 |
| 2008/0262493 | A1 | 10/2008 | Sutter | |
| 2010/0319202 | A1 * | 12/2010 | Lin | B26B 13/04 30/226 |
| 2014/0033543 | A1 | 2/2014 | Rhue | |

* cited by examiner

*Primary Examiner* — Laura M Lee

(57) ABSTRACT

A pair of scissors includes two handles (12, 14) having two overlapping shank portions (16, 18). Two recesses (20, 22) are formed on opposite inner faces of the shank portions (16, 18) respectively. Two blades (24, 26) are made of bendable and shape-retaining metal or alloy, and have inner end portions (28, 30) sandwiched between the shank portions (16, 18) and secured within the two recesses (20, 22) respectively. A pivot screw (50) is threaded through aligned screw holes and openings (32, 34, 36, 38) formed on the two shank portions (16, 18) and the inner end portions (28, 30). Two resilient blade covers (40, 42) are provided on two outer faces of the two blades (24, 26).

3 Claims, 4 Drawing Sheets

SCISSORS WITH BENDABLE AND SHAPE-RETAINING BLADES

CROSS-REFERENCE TO RELATED APPLICATIONS

This application is a continuation-in-part application of U.S. patent application Ser. No. 14/624,589, entitled "Method for Creating Stylish Haircuts of Various Shapes and Cutting Hair in One Push of a Button", filed Feb. 18, 2015, the entire content of which is hereby incorporated by reference.

FIELD OF THE TECHNOLOGY

The present application relates to a pair of scissors with bendable and shape-retaining blades.

BACKGROUND

A conventional pair of scissors usually has two straight and rigid blades for producing a straight cut of hair or other substances such as paper and cloth. Also, there exists scissors with two curved blades for cutting hair. However, this kind of scissors can only produce a curved cut. Since these conventional scissors are made of hard metal, the shapes of cut that can be created by them are quite limited, i.e. scissors with straight blades can only produce a straight cut, and scissors with curved blades can only produce a curved cut. Therefore, there is a need to provide a pair of scissors with bendable and shape-retaining blades that can create cuts of various shapes.

The above description of the background is provided to aid in understanding a pair of scissors, but is not admitted to describe or constitute pertinent prior art to the pair of scissors, or consider any cited documents as material to the patentability of the claims of the present application.

SUMMARY

According to one aspect, there is provided a pair of scissors with bendable and shape-retaining blades, the pair of scissors including:

- a pair of handles having two overlapping shank portions, two recesses being formed on two opposite inner faces of the two overlapping shank portions and extending from two free ends of the two overlapping shank portions towards the pair of handles respectively, the pair of handles and the two shank portions being non-bendable;
- a pair of blades having inner end portions sandwiched between the two overlapping shank portions and secured within the two recesses respectively, the pair of blades being made of a bendable and shape-retaining metal or alloy;
- a pivot screw threaded through two aligned screw holes formed on the two overlapping shank portions and passed through two aligned openings formed on the inner end portions respectively for pivotally connecting the two overlapping shank portions with the inner end portions secured thereinbetween; and
- a pair of resilient blade covers provided on two outer faces of the pair of blades respectively;
- wherein the pair of blades and the pair of blade covers are bendable together into a plurality of desired shapes for cutting hair and creating a plurality of haircuts of the desired shapes.

The bendable and shape-retaining metal or alloy may be selected from the group consisting of copper, copper alloy, aluminum, and aluminum alloy. The pair of resilient blade covers may be made of a shape-retaining plastic material selected from the group consisting of polyethylene, polyurethane, and polystyrene.

The two recesses are sized and shaped to fit therein the two inner end portions of the pair of blades respectively. The two recesses and the two inner end portions may be rectangular in shape.

The desired shapes may include a straight shape for producing a straight haircut, an upwardly curved shape for producing an upwardly curved haircut, a downwardly curved shape for producing a downwardly curved haircut, a generally U-shape for producing a generally U-shaped haircut, a generally V-shape for producing a generally V-shaped haircut, and a wavy shape for producing a wavy haircut.

According to another aspect, there is provided a pair of scissors including:

- a pair of handles having two overlapping shank portions, the pair of handles and the two shank portions being non-bendable;
- a pair of blades having inner end portions connected with the two overlapping shank portions respectively, the pair of blades being made of a bendable and shape-retaining metal or alloy; and
- a pivot screw threaded through two aligned screw holes formed on the two overlapping shank portions respectively for pivotally connecting the two overlapping shank portions;
- wherein the pair of blades is bendable into a plurality of desired shapes for producing cuts of the desired shapes.

In one embodiment, two recesses may be formed on two opposite inner faces of the two overlapping shank portions and may extend from two free ends of the two overlapping shank portions towards the pair of handles respectively. The inner end portions may be sandwiched between the two overlapping shank portions and secured within the two recesses respectively. Two openings may be formed on the inner end portions through which the pivot screw passes.

The bendable and shape-retaining metal or alloy may be selected from the group consisting of copper, copper alloy, aluminum, and aluminum alloy.

The pair of scissors may further include a pair of resilient blade covers provided on two outer faces of the pair of blades respectively. The pair of resilient blade covers may be made of a shape-retaining plastic material selected from the group consisting of polyethylene, polyurethane, and polystyrene.

The two recesses are sized and shaped to fit therein the two inner end portions of the pair of blades respectively. The two recesses and the two inner end portions may be rectangular in shape.

The pair of scissors can be a pair of hairdressing scissors for creating haircuts of the desired shapes. The plurality of desired shapes may include upward curve, downward curve, U-shape, V-shape, and wavy shape.

Although the pair of scissors is shown and described with respect to certain embodiments, it is obvious that equivalents and modifications will occur to others skilled in the art upon the reading and understanding of the specification. The pair of scissors in the present application includes all such equivalents and modifications, and is limited only by the scope of the claims.

BRIEF DESCRIPTION OF THE DRAWINGS

Specific embodiments of the pair of scissors will now be described by way of example with reference to the accompanying drawings wherein.

DETAILED DESCRIPTION

Figure 1:
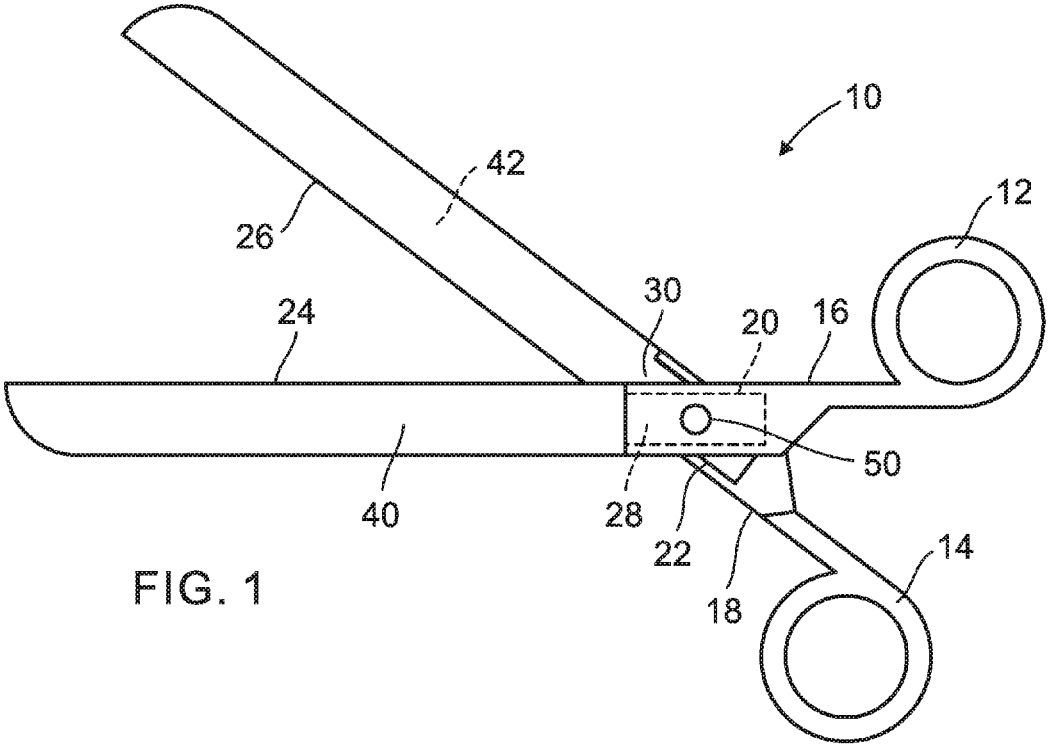
FIG. 1 is a top view of a pair of scissors with bendable and shape-retaining blades according to an embodiment disclosed in the present application.

Reference will now be made in detail to a preferred embodiment of the pair of scissors, examples of which are also provided in the following description. Exemplary embodiments of the pair of scissors are described in detail, although it will be apparent to those skilled in the relevant art that some features that are not particularly important to an understanding of the pair of scissors may not be shown for the sake of clarity.

Furthermore, it should be understood that the pair of scissors is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure and appended claims.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element or is in mechanical or electrical communication with another element.

FIGS. 1-4 show various views of an embodiment of a pair of scissors with bendable and shape-retaining blades. As used herein, the term "bendable" means (a long object) capable of being turned or bent by force from a straight form into a curved or angular form, as well as from a curved or angular form into some other form or back into the straight form. Similarly, as used herein, the term "bend" means turning (a long object) by force from a straight form into a curved or angular form, as well as from a curved or angular form into some other form or back into the straight form. As used herein, the term "shape-retaining" means (a long object) being able to hold its shape when bent and does not bounce back to its original position. And, as used herein, the term "bendable and shape-retaining metal or alloy" means a metal or alloy having bendable and shape-retaining characteristics so that when a long object is made of such metal or alloy, the long object can be bent and held in the bent shape without bouncing back to its original position.

The pair of scissors 10 may include a pair of handles 12, 14 having two overlapping shank portions 16, 18. The shank portion 16 can be integrally formed with the handle 12, and the shank portion 18 can be integrally formed with the handle 14. The pair of handles 12, 14 and the two overlapping shank portions 16, 18 may be made of stainless steel or any other suitable material, so that the pair of handles 12, 14 and the two overlapping shank portions 16, 18 may be rigid.

Figure 4:
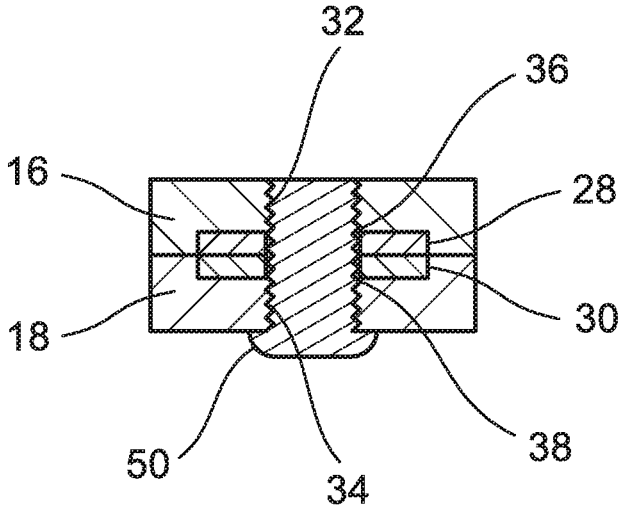
FIG. 4 is a cross sectional view taken along line 4-4 of the pair of scissors in FIG. 2.

As best illustrated in FIG. 4, a pivot screw 50 may thread through two aligned internally threaded holes or screw holes 32, 34 formed on the two shank portions 16, 18 respectively for pivotally connecting the two shank portions 16, 18. The two screw holes 32, 34 may be formed at a central position of the two shank portions 16, 18. Although it has been shown and described that a pivot screw is used to pivotally connect the two shank portions 16, 18 it is understood that other fastening means such as a pivot pin with enlarged heads at two opposite ends may be used.

Two recesses 20, 22 may be formed on two opposite inner faces of the two overlapping shank portions 16, 18 respectively. The recesses 20, 22 may extend from two free ends 52, 54 of the two overlapping shank portions 16, 18 towards the pair of handles 12, 14 in a longitudinal direction of the pair of scissors 10. The recesses 20, 22 may be rectangular in shape.

A pair of blades 24, 26 can be connected with the two shank portions 16, 18 of the pair of handles 12, 14. Both or one of the pair of blades 24, 26 may have a sharpened cutting edge. According to the illustrated embodiment shown in FIG. 3, the pair of blades 24, 26 can be formed with two sharpened cutting edges 56, 58 respectively. The pair of blades 24, 26 may be made of a bendable and shape-retaining metal or alloy, such as copper, copper alloy, aluminum, aluminum alloy, or any other suitable metal or alloy. Although it has been shown and described that the pair of blades 24, 26 are straight blades, it is appreciated that one of the pair of blades 24, 26 can be a toothed blade.

The pair of blades 24, 26 may have two inner end portions 28, 30 sandwiched between the two overlapping shank portions 16, 18 and secured within the two recesses 20, 22 respectively. The two recesses 20, 22 are sized and shaped to fit therein the inner end portions 28, 30 of the pair of blades 24, 26. According to the illustrated embodiment, the two recesses 20, 22 and the two inner end portions 28, 30 of the pair of blades 24, 26 are rectangular in shape.

The two inner end portions 28, 30 may have a width narrower than that of the pair of blades 24, 26. The two inner end portions 28, 30 can be formed with two openings 36, 38 respectively, as illustrated in FIG. 4. The two openings 36, 38 may also be formed at a central position of the inner end portions 28, 30, and are adapted to align with the two screw holes 32, 34 formed on the two overlapping shank portions 16, 18.

To pivotally connect the pair of blades 24, 26 to the shank portions 16, 18 of the handles 12, 14, one can first put the inner end portions 28, 30 of the pair of blades 24, 26 into the two recesses 20, 22 respectively. When the inner end portion 28 of the blade 24 is put into the recess 20 of the shank portion 16, the opening 36 of the inner end portion 28 should align with the screw hole 32 of the shank portion 16. Similarly, when the inner end portion 30 of the blade 26 is put into the recess 22 of the shank portion 18, the opening 38 of the inner end portion 30 should align with the screw hole 34 of the shank portion 18. Then, the two screw holes 32, 34 and the two openings 36, 38 are aligned together. Finally, the pivot screw 50 is threaded through the screw hole 34, passes through the two openings 36, 38, and then threaded through the screw hole 32. The pivot screw 50 is tightened and the connection of the pair of blades 24, 26 to the two overlapping shank portions 16, 18 of the pair of handles 12, 14 is completed.

In this position, the two inner end portions 28, 30 of the pair of blades 24, 26 can be tightly secured within the two recesses 20, 22, and yet the two overlapping shank portions 16, 18 of the pair of handles 12, 14 are free to pivot. To replace the pair of blades 24, 26, one can simply unfasten the pivot screw 50 and replace the old blades with new blades.

Although it has been shown and described that the two bendable and shape-retaining blades 24, 26 are connected to the two overlapping shank portions 16, 18 by sandwiching the two inner end portions 28, 30 between the two overlapping shank portions 16, 18 and securing them within the two recesses 20, 22 formed on the opposite inner faces of the two overlapping shank portions 16, 18, it is understood by one skilled in the art that the two bendable and shape-retaining blades 24, 26 can be connected to the two overlapping shank portions 16, 18 in many other possible ways. For example, the inner end portions 28, 30 of the two bendable and shape-retaining blades 24, 26 can be inserted into two slots formed at the free ends 52, 54 of the two overlapping shank portions 16, 18 respectively, and then secured by the pivot screw 50. Another possible way of connection is to have the inner end portions 28, 30 of the two bendable and shape-retaining blades 24, 26 sandwiched between and attached to the opposite inner faces of the two overlapping shank portions 16, 18 without the formation of recesses 20, 22 thereon. A further possible way of connection is to directly connect the inner ends of the two bendable and shape-retaining blades 24, 26 to the free ends 52, 54 of the two overlapping shank portions 16, 18 respectively.

The pair of scissors 10 disclosed in the present application may be further provided with a pair of resilient blade covers 40, 42. The pair of resilient blade covers 40, 42 may be provided on two outer faces 44, 46 of the pair of blades 24, 26 respectively. The resilient blade covers 40, 42 may be adhered onto the pair of blades 24, 26 by suitable adhesive material. The resilient blade covers 40, 42 can serve to protect users from injury by the blades 24, 26 during bending of the blades 24, 26 and during a cutting process.

The pair of resilient blade covers 40, 42 may be made of shape-retaining plastic that can retain their shapes when bent. The shape-retaining plastic may be polyethylene, polyurethane, polystyrene, or any other appropriate material.

Figure 10:
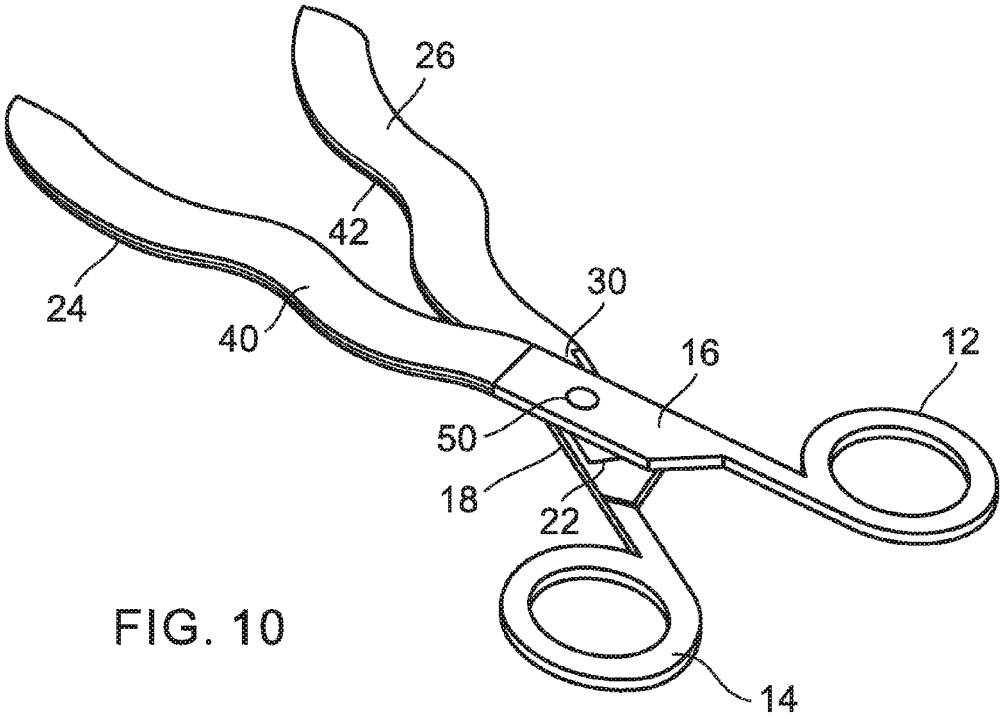
FIG. 10 is a perspective view of the pair of scissors with the bendable and shape-retaining blades being bent into a wavy shape.

To prepare the pair of scissors 10 for cutting hair, a user first closes the scissors 10 by bringing the pair of blades 24, 26 together so that one blade is lying on top of the other. For creating a straight haircut, it is not necessary to bend the blades 24, 26. For creating a particular curved haircut such as a wavy haircut, the user needs to bend the pair of blades 24, 26 together with the blade covers 40, 42 into a wavy shape. The user then holds the handles 12, 14 of the scissors 10 by one hand and opens the scissors 10 by moving the two handles 12, 14 apart from each other so that the pair of blades 24, 26 would be moved away from each other to a ready-to-cut position, as depicted in FIG. 10. Then, the user can close the scissors 10 to cut hair between the two blades 24, 26. A wavy haircut would be created. In this respect, the length of the two blades 24 may have to be longer than that of regular scissors so that the two blades 24 can have a length sufficient to be bent into different desired shapes.

Figure 2:
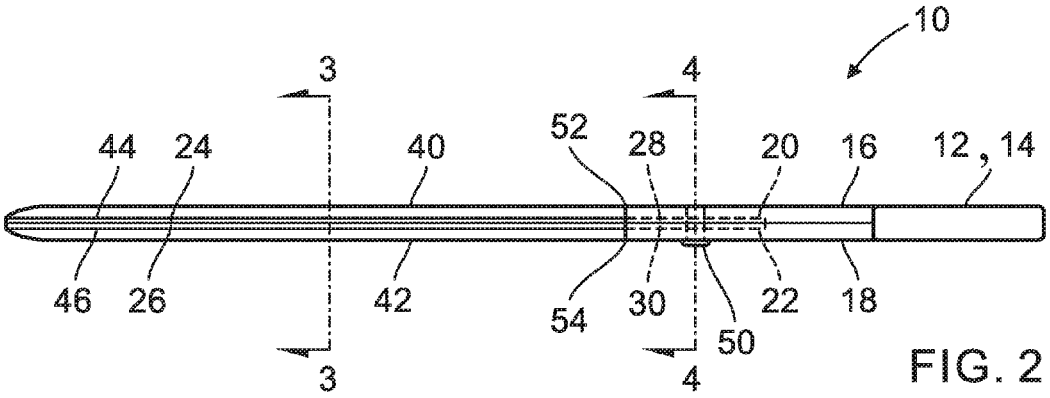
FIG. 2 is a side view of the pair of scissors in FIG. 1.
Figure 3:
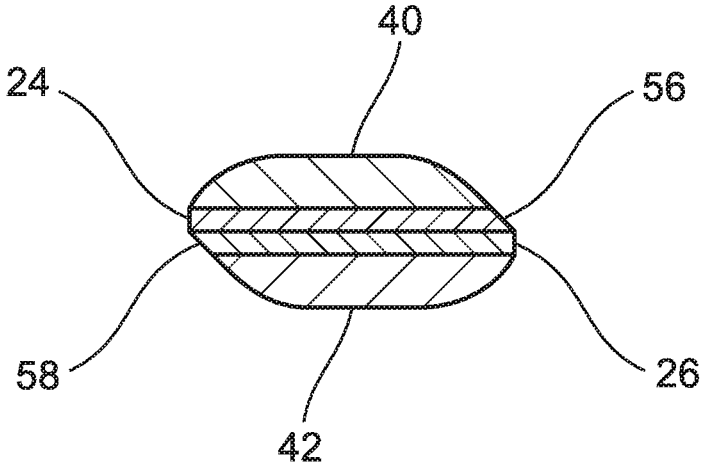
FIG. 3 is a cross sectional view taken along line 3-3 of the pair of scissors in FIG. 2.

When the pair of blades 24, 26 and the pair of blade covers 40, 42 are straight and not bent into any shape, as shown in FIG. 2, the pair of scissors 10 can be used to create a "straight cut" of the hair at the back a head, or a "straight bangs cut" of the hair above the forehead.

Figure 5:
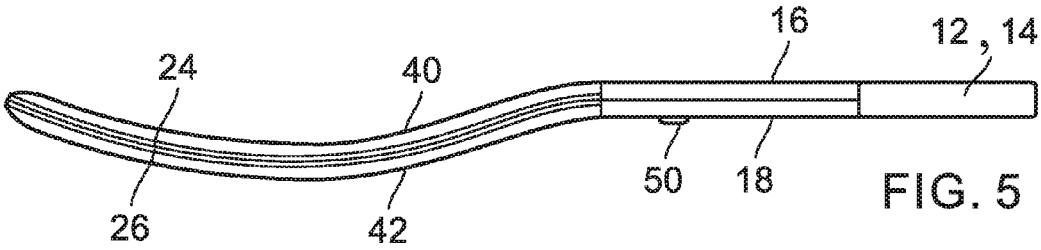
FIG. 5 is a side view of the pair of scissors with the bendable and shape-retaining blades being bent into an upward curve.

FIG. 5 shows the pair of scissors 10 with the bendable and shape-retaining blades 24, 26 and the resilient blade covers 40, 42 being bent into an upward curve. A user using this pair of scissors 10 can create upwardly curved haircuts, such as an "upwardly curved cut" of the hair at the back of a head.

Figure 6:
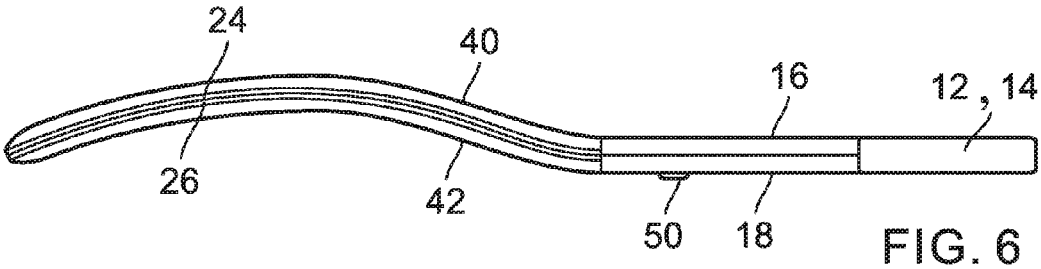
FIG. 6 is a side view of the pair of scissors with the bendable and shape-retaining blades being bent into a downward curve.

FIG. 6 shows the pair of scissors 10 with the bendable and shape-retaining blades 24, 26 and the resilient blade covers 40, 42 being bent into a downward curve. A user using this pair of scissors 10 can create downwardly curved haircuts, such as a "downwardly curved bangs cut" of the hair above the forehead.

Figure 7:
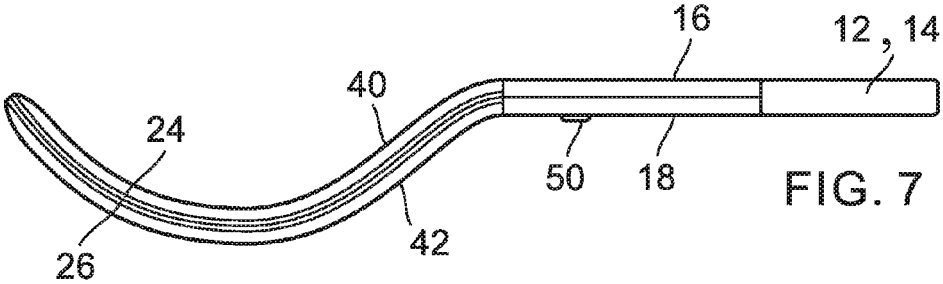
FIG. 7 is a side view of the pair of scissors with the bendable and shape-retaining blades being bent into a generally U-shape.

FIG. 7 shows the pair of scissors 10 with the bendable and shape-retaining blades 24, 26 and the resilient blade covers 40, 42 being bent into a generally U-shape. A user using this pair of scissors 10 can create generally U-shaped haircuts, such as a "U-shaped cut" of the hair at the nape area at the back of a head.

Figure 8:
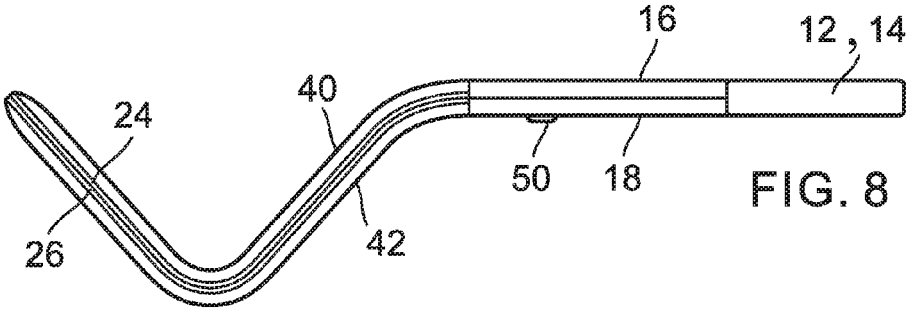
FIG. 8 is a side view of the pair of scissors with the bendable and shape-retaining blades being bent into a generally V-shape.

FIG. 8 shows the pair of scissors 10 with the bendable and shape-retaining blades 24, 26 and the resilient blade covers 40, 42 being bent into a generally V-shape. A user using this pair of scissors 10 can create generally V-shaped haircuts, such as a "V-shaped cut" of the hair at the back of a head.

Figure 9:
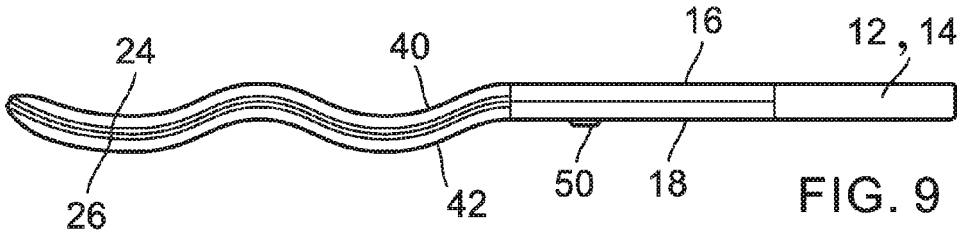
FIG. 9 is a side view of the pair of scissors with the bendable and shape-retaining blades being bent into a wavy shape.

FIG. 9 shows the pair of scissors 10 with the bendable and shape-retaining blades 24, 26 and the resilient blade covers 40, 42 being bent into a wavy shape. A user using this pair of scissors 10 can create wavy haircuts, such as a "wavy cut" of the hair at the back of a head.

Hence, stylish haircuts of various shapes can be created using the pair of scissors 10 with bendable and shape-retaining blades 24, 26 disclosed in the present application.

Although it has been shown and described that the pair of scissors 10 is used for cutting hair, it is contemplated that the pair of scissors 10 can be used to cut other substances such as paper, cardboard, cloth, etc.

While the pair of scissors has been shown and described with particular references to a number of preferred embodiments thereof, it should be noted that various other changes or modifications may be made without departing from the scope of the appended claims.

What is claimed is:

1. A pair of scissors with bendable and shape-retaining blades, the pair of scissors comprising:

(a) a pair of handles (12, 14) having two overlapping shank portions (16, 18), two recesses (20, 22) being formed on two opposite inner faces of the two overlapping shank portions (16, 18) and extending from two free ends (52, 54) of the two overlapping shank portions (16, 18) towards the pair of handles (12, 14) respectively, the pair of handles (12,14) and the two overlapping shank portions (16, 18) being rigid;

(b) a pair of blades (24, 26) having inner end portions (28, 30) sandwiched between the two overlapping shank portions (16, 18) and secured within the two recesses (20, 22) respectively, the pair of blades (24, 26) being made of a bendable and shape-retaining material selected from the group consisting of copper, copper alloy, aluminum, and aluminum alloy;

(c) a pivot screw (50) threaded through two aligned screw holes (32, 34) formed on the two overlapping shank portions (16, 18) and passed through two aligned openings (36, 38) formed on the inner end portions (28, 30) respectively for pivotally connecting the two overlapping shank portions (16, 18) with the inner end portions (28, 30) secured thereinbetween; and (d) a first resilient blade cover (40) adhered to an outer face (44) of one blade (24), and a second resilient blade cover (42) adhered to an outer face (46) of the other blade (26), the first and second resilient blade covers (40, 42) being made of a shape-retaining plastic material selected from the group consisting of polyethylene, polyurethane, and polystyrene;

(e) wherein the pair of blades (24, 26) and the pair of blade covers (40, 42) are capable of being manipulated together and bent into multiple desired shapes for cutting hair and creating a plurality of haircuts of the desired shapes; and (f) wherein the multiple desired shapes comprise a straight shape, an upwardly curved shape, a downwardly curved shape, a generally U-shape, a generally V-shape, and a wavy shape.

2. The pair of scissors with bendable and shape-retaining blades as claimed in claim 1, wherein the two recesses (20, 22) are sized and shaped to fit therein the two inner end portions (28, 30) of the pair of blades (24, 26) respectively.

3. The pair of scissors with bendable and shape-retaining blades as claimed in claim 2, wherein the two recesses (20, 22) and the two inner end portions (28, 30) are rectangular in shape.

* * * * *